US006098370A

United States Patent [19]

Kobayashi et al.

[11] Patent Number: 6,098,370

[45] Date of Patent: Aug. 8, 2000

[54] BINDING MACHINE

[75] Inventors: Kenji Kobayashi; Tomiei Nakamura; Masaki Haruta, all of Tokyo, Japan

[73] Assignee: Max Co., Ltd., Tokyo, Japan

[21] Appl. No.: 09/249,779

[22] Filed: Feb. 16, 1999

[30] Foreign Application Priority Data

Feb. 16, 1998 [JP] Japan ..... 10-033322
Mar. 27, 1998 [JP] Japan ..... 10-081826

[51] Int. Cl.[7] ..... B65B 51/04

[52] U.S. Cl. ..... 53/138.3; 53/139.1; 53/583

[58] Field of Search ..... 53/138.2, 138.3, 53/138.4, 138.7, 138.9, 139.1, 583

[56] References Cited

U.S. PATENT DOCUMENTS 3,910,811 10/1975 Paxton et al. ..... 156/521
3,983,681 10/1976 Britt et al. ..... 53/138.3
5,269,120 12/1993 Holmes ..... 53/411
5,485,711 1/1996 Suzuki et al. ..... 53/138.3

FOREIGN PATENT DOCUMENTS 2 235 837 1/1975 France .
44 29 694 A1 3/1995 Germany .
2571341 2/1998 Japan .
520024 3/1972 Switzerland .

*Primary Examiner*—Peter Vo
*Assistant Examiner*—Louis L. Huynh
*Attorney, Agent, or Firm*—Morgan, Lewis & Bockius LLP

[57] ABSTRACT

A bag binder comprises; a binding-piece feeding member for feeding a binding piece to a position adjacent to the bag, the binding piece made of a synthetic resin and including a pair of leg portions for binding the bag; a crossing member for crossing the leg portions by pressing the leg portions of the binding pieces; and a bonding member for bonding the leg portions of the binding pieces each other so as to crosswise engage a crossed portion of the leg portions each other.

10 Claims, 12 Drawing Sheets

BINDING MACHINE

BACKGROUND OF THE INVENTION

1. Field of the Invention

The present invention relates to a binding machine especially for binding a bag with a resin binding piece.

2. Description of the Related Art

As a binding machine which binds an opening of a bag made of a resin such as polyethylene and containing an article(s) to be packed, the assignee of the present application has proposed a binding machine, hereinafter simply named as a bag binder, which automatically fastens a resin binding piece that can be easily attached and detached so as to be repeatedly used, to an opening of a bag (Japanese Utility Model Publication No. Hei. 7-15514).

FIG. 1 shows the bag binder 1. Binding pieces 2 which are configured by a resin plate and linked to one another into a belt-like shape are housed in a binding piece magazine 3. The binding pieces are sequentially fed to a binding device 6 by ratchet pawls 5 of a binding-piece feeding mechanism 4. A cutter (not shown) which is interlocked with the forward movement of the binding-piece feeding mechanism 4 cuts the portion where the leading binding piece 2*a* and the next binding piece 2*b* are linked to each other, and a twisting arm 7 of the binding device 6 rotates to twist two legs of the leading binding piece 2*a*.

The tip ends of the legs are restricted in rotation by a fixed forming jig 8, and hence the binding piece 2*a* twisted by the twisting arm 7 is bent into a funnel-like shape, so that hooking portions of the tip ends are crosswise engaged with each other.

An opening portion of a resin bag is inserted from the above into a guiding groove 9 which is formed between the binding-piece feeding mechanism 4 and the binding device 6, to be puckered. The above-mentioned series of operations cause the binding piece 2 to be first fitted onto the puckered portion of the bag, and then twisted, with the result that the bag B is bound with the binding piece 2 as shown in FIG. 2.

In the bag binder 1, the binding piece 2 is twisted by the twisting arm 7 so as to be fastened to the bag, and hence a space for rotation of the twisting arm 7 and the binding piece 2 must be ensured. As shown in FIG. 2, therefore, the bag B cannot be bound in a tension state, and the binding piece is attached to an upper position which is separated from the contents of the bag. As a result, a room in which the contents can be moved is formed in the bag. When vegetables or fruits are packed, for example, the vegetables or fruits may rub against each other to produce damages such as scratches or deformation on them.

SUMMARY OF THE INVENTION

It is an object of the invention to provide a bag binder which can bind a bag in a tension state where contents are tightly fastened so as not to be moved in the bag, and which is therefore suitable for packing of vegetables or fruits, or the like.

The above object can be attained by a bag binder comprising: a binding-piece feeding member which fits a binding piece onto a puckered portion of a bag, the binding piece being formed by a portal flat plate of a synthetic resin; and a pressing member which presses legs of the binding piece in a closing direction, thereby crossing the legs with each other, the bag binder further comprising press-bonding means for press-bonding crosswise engaging portions of the binding piece which are crossed by the pressing member.

In the bag binder, preferably, the press bonding is performed by forming means for forming a dowel shape, and crimping means for crimping the dowel shape.

According to this configuration, the bag binder attaches a binding piece to a puckered portion of a bag by pressing the outer side of the legs of the binding piece. Unlike a bag binder of the prior art which attaches a binding piece to a bag by twisting legs of a binding piece, therefore, a binding piece can be attached to a bag in close proximity to contents of the bag, so that the bag is bound in a tension state.

The above object can be attained also by a bag binder comprising: a binding-piece feeding member for feeding a binding piece to a position adjacent to the bag, the binding piece made of a synthetic resin and including a pair of leg portions for binding the bag; a crossing member for crossing the leg portions by pressing the leg portions of the binding pieces; and a bonding member for bonding the leg portions of the binding pieces each other so as to crosswise engage a crossed portion of the leg portions each other.

It is a second object of the invention to provide a bag binder which can bind a bag under a state where contents are tightly fastened so as not to be moved in the bag, which can perform a stable binding operation as well as suitable packing of vegetables or fruits, or the like.

The second object can be attained by a bag binder comprising: a binding-piece feeding member which fits a binding piece onto a puckered portion of a bag, the binding piece being formed by a portal flat plate of a synthetic resin; a binding member which presses legs of the binding piece in a closing direction, thereby crossing the legs with each other; and a waiting position controller for a bag binder. The binding member crosswise engages or press-bonds the legs with each other. The bag binder performs one cycle of a binding operation by one rotation of a main gear which is driven by a motor. The waiting position controller stops a driving of the motor in accordance with end-of-cycle detecting means such as a switch, thereby stopping the feeding member and the binding member at waiting positions.

A disk is coaxially attached to the main gear. An index portion such as a notch or a mirror portion is formed in an edge portion of the disk, and a photo-sensor which detects the index portion is disposed, thereby constituting rotary end-of-cycle detecting means. Controlling means is disposed for starting breaking of a driving system, in response to an index portion detection signal from the photo-sensor, and for stopping the motor, at a timing when the index portion detection signal is turned off.

The above object can be attained also by a binding machine for binding a bag comprising: a binding-piece feeding member for feeding a binding piece to a position adjacent to the bag, the binding piece made of a synthetic resin and including a pair of leg portions for binding the bag; a crossing member for crossing the leg portions by pressing the leg portions of the binding pieces; a bonding member for bonding the leg portions of the binding pieces each other so as to crosswise engage a crossed portion of the leg portions each other; and a controller for controlling a binding operation with the binding-piece feeding member, the crossing member, and the bonding member. The controller comprising; a main gear driven by a motor, one rotation of which performs one cycle of the binding operation; a disk coaxially attached to the main gear, the disk including an index portion provided at an edge portion of the disk; and a photo-sensor detecting the index portion so as to detect one cycle of the binding operation.

It is a third object of the invention to provide a bag binder which can bind a bag in a tension state where contents are tightly fastened so as not to be moved in the bag, in which a work of removing a binding piece can be safely performed as well as suitable binding for packing of vegetables or fruits, or the like.

The third object can be attained by a bag binder comprising: a binding-piece feeding member which fits a binding piece onto a puckered portion of a bag, the binding piece being formed by a portal flat plate of a synthetic resin; and a binding member which presses legs of the binding piece in a closing direction, thereby crossing the legs with each other;

The binding member crosswise engages or press-bonds the legs with each other. The bag binder performs one cycle of a binding operation by swinging a trigger lever, wherein an openable flap is disposed in a portion of an outer case where the binding member is incorporated. A stopper for restricting the swing of the trigger lever is disposed on the flap. The stopper advances into a swinging path of the trigger lever when the flap is opened, thereby blocking the swing of the trigger lever, and the stopper retracts from the swinging path of the trigger lever when the flap is closed, thereby allowing the swing of the trigger lever.

The above object can be attained also by a binding machine for binding a bag comprising: a binding-piece feeding member for feeding a binding piece to a position adjacent to the bag, the binding piece made of a synthetic resin and including a pair of leg portions for binding the bag; a crossing member for crossing the leg portions by pressing the leg portions of the binding pieces; a bonding member for bonding the leg portions of the binding pieces each other so as to crosswise engage a crossed portion of the leg portions each other; and a trigger lever which starts one cycle of a binding operation with the binding-piece feeding member, the crossing member, the bonding member; and a flap lid provided on the bonding device. The flap lid including a stopper for restricting a rotation of the trigger lever.

DETAILED DESCRIPTION OF THE PREFERRED EMBODIMENT

Figure 1:
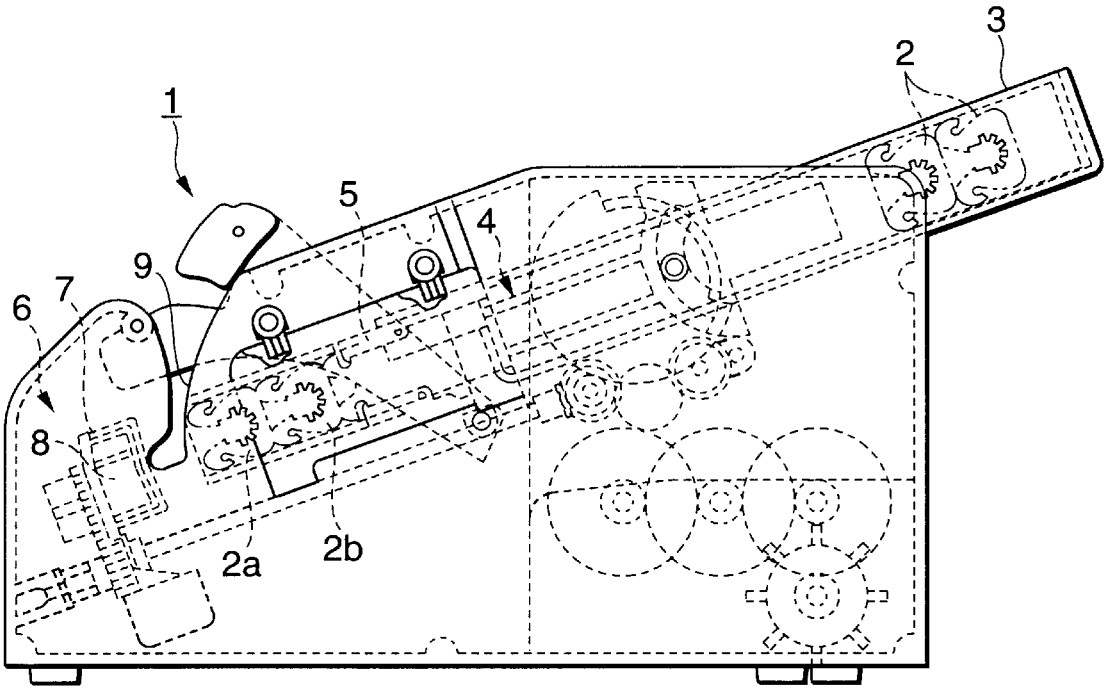
FIG. 1 is a side view of a bag binder of the prior art.
Figure 2:
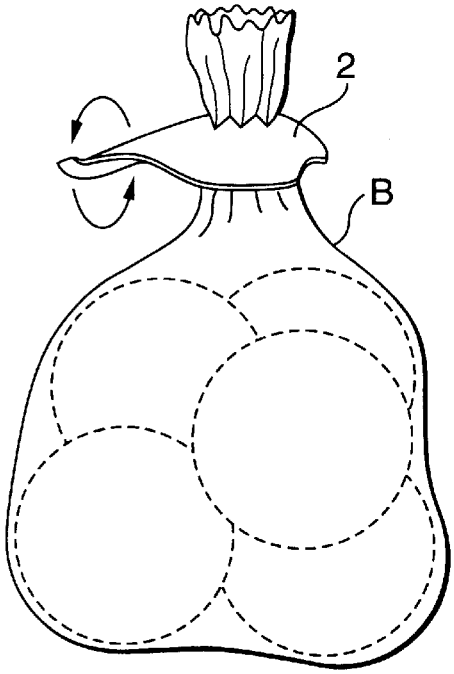
FIG. 2 is a front view of a bag which is bound by the bag binder of the prior art.
Figure 3:
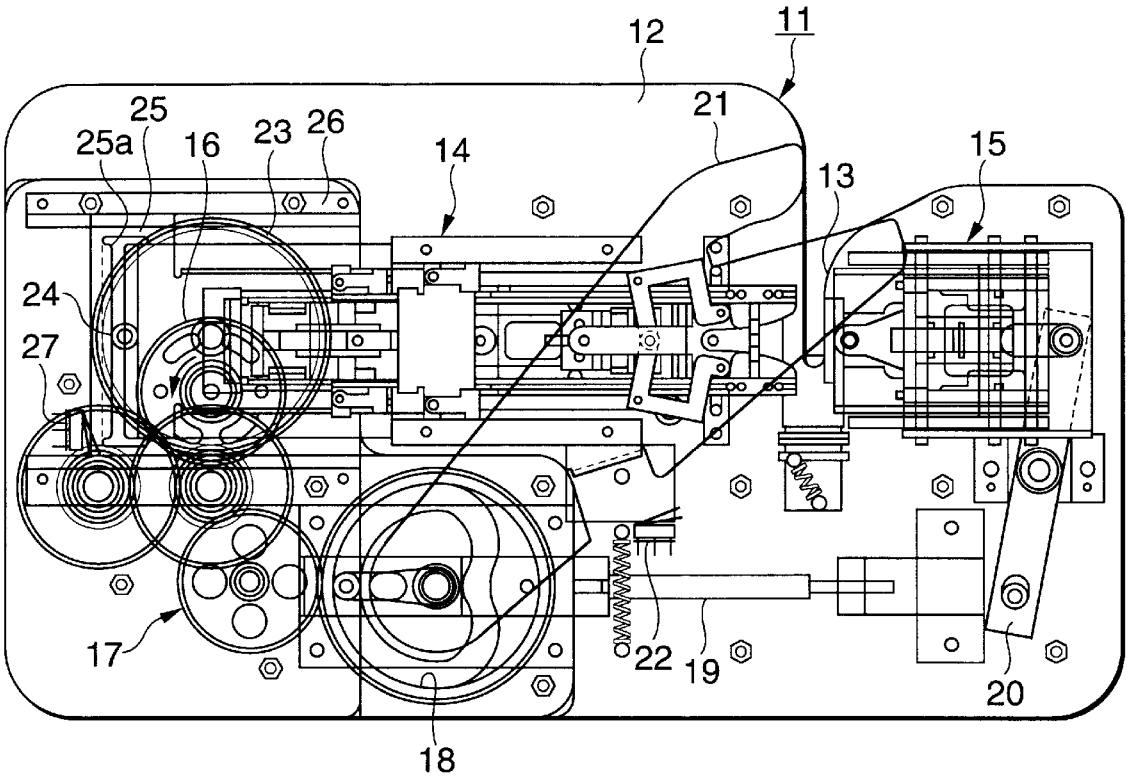
FIG. 3 is a transparent view of a bag binder which is a first embodiment of the invention.

Hereinafter, a first embodiment of the invention will be described in detail with reference to FIGS. 3 to 10. FIG. 3 shows a bag binder 11. In an outer case 12, a binding device 14 and a crimping device 15 are opposed to each other across a guiding groove 13 which is downward formed from the upper face of the front portion of the outer case 12. The binding device 14 and the crimping device 15 are driven by a motor 16 and a reduction gear mechanism 17, and the crimping device 15 is driven by the reduction gear mechanism 17 via a cam 18, a slider 19, and a lever 20.

When an opening portion of a resin bag is puckered and inserted into the guiding groove 13, a trigger arm 21 is pushed by the bag to downward swing, whereby a trigger switch 22 is turned on to activate the motor 16. The motor 16 rotates a main gear 23 via the reduction gear mechanism 17.

An eccentric pin 24 disposed on a side face of the main gear 23 is engaged with a long hole 25*a* of a carrier 25 of the binding device 14. When the main gear 23 makes one rotation, the carrier 25 is driven to make a round trip in a longitudinal direction along a carrier guide 26. After the binding operation is ended, the carrier 25 returns to the initial position and the rear end of the carrier 25 pushes a stop switch 27, thereby ending one cycle of the operation.

Figure 4:
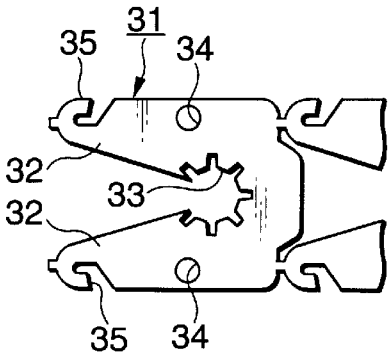
FIG. 4 is a front view of a binding piece.

As shown in FIG. 4, a binding piece 31 is formed by a resin flat plate having a substantially portal shape. A locking pawl portion 33 in the form of internal teeth is disposed in an internal basal portion between right and left legs 32. Holes 34 with which pins (described later) of the binding device 14 are to be engaged are formed in the right and left legs 32, respectively. A groove is formed in the outer side of the tip end portion of each of the legs, thereby constituting a hooking portion 35. A number of binding pieces 31 are molded into a belt-like shape with being aligned in a row and directing the respective legs 32 to the front. The belt of binding pieces is wound into a roll, and then loaded into a magazine (not shown) of the bag binder 11.

Figure 5:
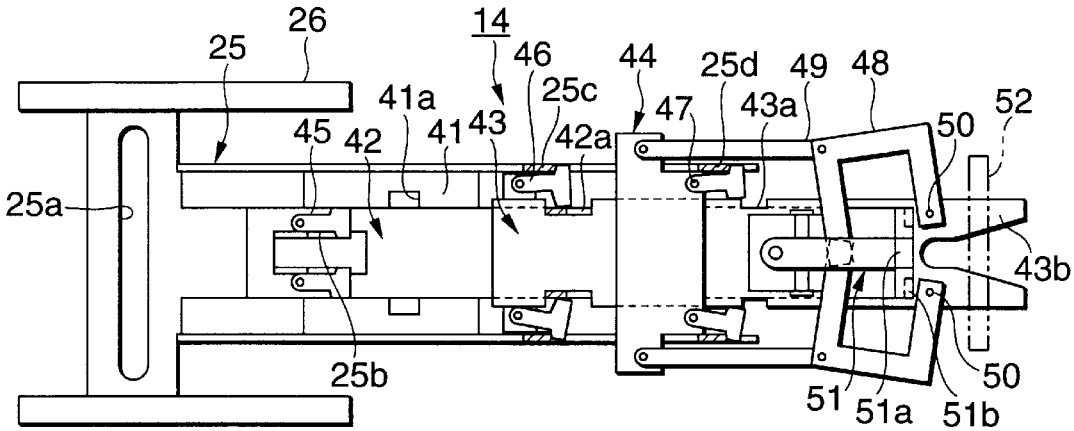
FIG. 5 is a view showing the configuration of a binding device of the bag binder, and illustrating an initial state.

FIG. 5 is a partially schematic illustration of the shape of the binding device 14. As shown in the figure, the binding device 14 comprises: a slide guide 41 which is to be fixed to a base (not shown) of the bag binder 11; a binding piece guide slider 42 attached to the slide guide 41; a cover slider 43 attached to the upper face of the binding piece guide slider 42; a binding slider 44 attached onto the cover slider 43; and the carrier 25.

Lateral pairs of swing arms 45, 46, and 47 are pivotally mounted to the three sliders 42, 43, and 44 of the upper, middle, and lower stages so as to be horizontally swingable, respectively. The arms are directed to the front.

A pawl which laterally protrudes is formed in a front end portion of each of the swing arms 45, 46, and 47. In each of the pawls, a rear edge portion has an inclined face where the outer side is in a more advanced position. The carrier 25 is provided with pawls 25*b*, 25*c*, and 25*d* which are respectively engageable with the pawls of the swing arms 45, 46, and 47.

In the initial position shown in FIG. 5, the swing arms 45 which are on the both sides of the binding piece guide slider 42 are contacted with the inner side faces of the slide guide 41 so that the outward swing of the arms is restricted, and the inner pawls are engaged with the pawls 25*b* of the carrier 25. In the slide guide 41, holes 41*a* are formed in positions which are more forward than the swing arms 45 of the binding piece guide slider 42 that is in the initial position. When the binding piece guide slider 42 is advanced integrally with the carrier 25 under the state where the swing arms 45 are engaged with the pawls 25*b* of the carrier 25, and the outer pawls of the swing arms 45 reach the positions of the holes 41*a* of the slide guide 41, the swing arms 45 which are engaged with the pawls 25*b* of the carrier 25 are outward rotated by the function of the inclined faces of the pawls of the swing arms 45, and the outer pawls enter the holes 41*a*, with the result that the engagement between the binding piece guide slider 42 and the swing arms 45 is canceled.

For the swing arms 46 which are on the both sides of the cover slider 43, the inner pawls are contacted with the outer side faces of the binding piece guide slider 42 so that the outward swing of the arm is restricted, and the outer pawls are engaged with the pawls 25*c* of the carrier 25. In the binding piece guide slider 42, holes 42*a* are formed in positions which are more forward than the swing arms 46 of the cover slider 43. When the cover slider 43 is advanced by a predetermined distance with respect to the binding piece guide slider 42, the inner pawls of the swing arms 46 are engaged with the holes 42*a* of the binding piece guide slider 42, with the result that the engagement between the cover slider 43 and the carrier 25 is canceled.

For the binding slider 44, similarly, the swing arms 47 on the both sides are contacted with the outer side faces of the cover slider 43, and the outer pawls are engaged with the pawls 25*d* of the carrier. When the binding slider 44 is advanced by a predetermined distance with respect to the cover slider 43, the inner pawls of the swing arms 47 are engaged with the holes 43*a* of the outer side faces of the cover slider 43, with the result that the engagement between the binding slider 44 and the carrier 25 is canceled.

A binding piece table 43*b* which is similar in shape to the binding piece 31 is formed in a front portion of the cover slider 43 and in the same plane as the binding piece guide slider 42. Basal portions of a pair of right and left binding arms 48 are pivotally mounted to the rear portion of the table. The binding arms 48 are coupled to the binding slider 44 via links 49. When the binding slider 44 is relatively advanced with respect to the cover slider 43, tip end portions of the right and left binding arms 48 are swung in the closing direction. A vertical pin 50 protrudes from the tip end portion of each of the binding arms 48. The pins 50 are engaged with the holes 34 on the both sides of the binding piece 31 shown in FIG. 4.

A binding piece cutter 51 is attached to the upper face of the cover slider 43 by means of a shaft, so as to be vertically swingable. The upper face of the front portion of the binding piece cutter 51 is formed as an inclined face 51*a* which is downward inclined as moving toward the front. A downward cutter blade 51*b* is formed in each of the right and left front end portions of the cutter.

The front end of the binding piece guide slider 42 is positioned so as to be below the binding piece cutter 51 and opposed to the cutter blades 51*b*, and serves as a receiving table which receives share stress of the cutter blades 51*b* when a binding piece is to be cut off.

Hereinafter, the operation of the binding device 14 will be described. When the motor 16 is activated as a result of the above-described operation of inserting a bag into the bag binder 11, the binding piece guide slider 42, the cover slider 43 and the binding slider 44 are forward pushed from the initial positions shown in FIG. 5, by the pawls 25*b*, 25*c*, and 25*d* of the carrier 25, so as to be integrally advanced.

At this time, the pins 50 of the binding arms 48 are engaged with the holes 34 of the leading binding piece (not shown), and the binding pieces in the form of a belt are advanced together with the binding piece guide slider 42, so that the leading binding piece on the binding piece table 43*b* of the cover slider 43 is fitted onto a puckered portion of a bag which is in the guiding groove. At the same time, the upper inclined face 51*a* of the binding piece cutter 51 abuts against a stationary bar 52 which elongates above the binding piece cutter 51 (in this side of the sheet in FIG. 5), thereby causing the front portion of the binding piece cutter 51 to be downward swung. As a result, the portion where the leading binding piece 31*a* and the next binding piece 31*b* are linked to each other is pushingly cut by the cutter blades 51*b* and the front end portion of the upper face of the binding piece guide slider 42.

The swing arms 45 of the binding piece guide slider 42 enter the holes 41*a* of the slide guide 41, and the engagement between the binding piece guide slider 42 and the carrier 25 is canceled, so that the binding piece guide slider 42 stops after performing a predetermined forward stroke.

Thereafter, the cover slider 43 and the binding slider 44 are pushed by the carrier 25 to be further advanced, and the swing arms 46 of the cover slider 43 enter the holes 42*a* of the binding piece guide slider 42, thereby canceling the engagement between the cover slider 43 and the carrier 25.

As a result, the cover slider 43 stops. In this case, since the cover slider 43 is advanced after the binding piece guide slider 42 stops, a gap is formed between the binding piece table 43*b* of the cover slider 43 and the front end of the binding piece guide slider 42, so that the rear portion of the binding piece 31*a* fitted onto the puckered portion of the bag is not supported by the binding piece guide slider 42.

Figure 6:
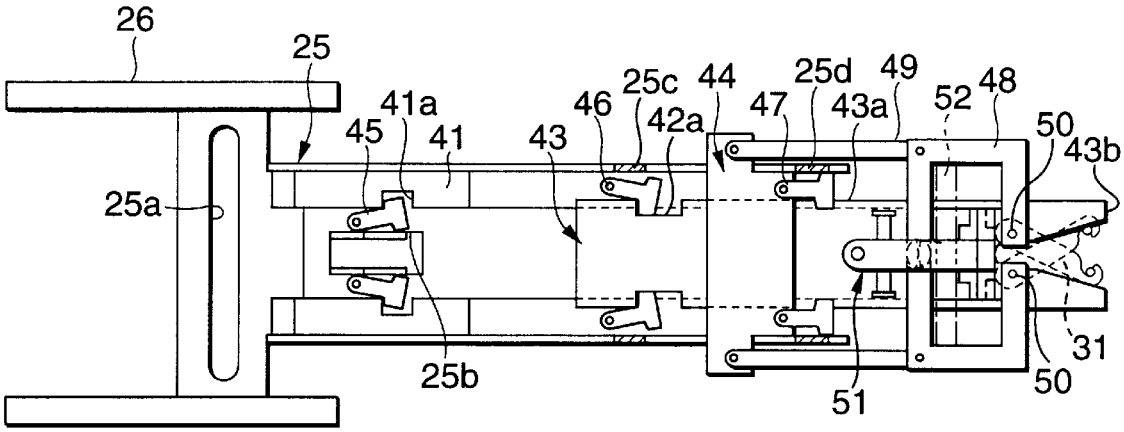
FIG. 6 is a view illustrating a binding step in the binding device.

Thereafter, the binding slider 44 only is further advanced by the carrier 25, so that, as shown in FIG. 6, the binding arms 48 are swung in the closing direction via the links 49. Since the pins 50 at the tip ends of the binding arms 48 are engaged with the holes 34 of the binding piece 31, the legs of the binding piece 31 are twisted in the closing direction, and the legs 32 are overlapped each other, so that the binding piece 31 is elastically deformed into a funnel-like shape. As described above, the rear portion of the binding piece 31 is not supported. Therefore, the deformation of the binding piece 31 is not impeded, and the rear portion of the binding piece 31 which is elastically deformed into a funnel-like shape is downward projected.

As shown in FIG. 6, the swing arms 47 of the binding slider 44 then enter the holes 43*a* of the cover slider 43, so that the engagement between the carrier 25 and the binding slider 44 is canceled. As a result, the binding slider 44 stops under a state where the legs of the binding piece 31 are overlapped each other. At the same time when the binding slider 44 stops, the rotation of the cam 18 shown in FIG. 3 causes the crimping device 15 to operate, so that the legs 32 of the binding piece 31 are vertically crimped.

Figure 7A:
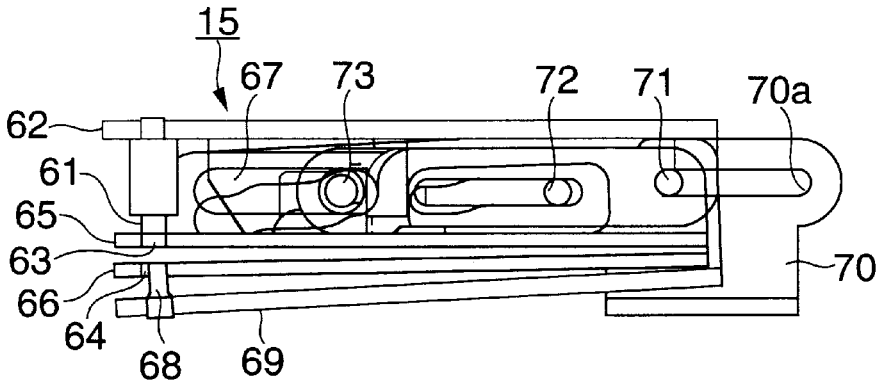
FIGS. 7A to 7C are views illustrating a crimping step by a crimping device.

FIG. 7A shows the crimping device 15. The crimping device comprises: a crimp plate 62 having a crimp pin 61 which is downward directed; two upper and lower presser plates 65 and 66 respectively having dowel forming holes 63 and 64; a lock plate 67; a press plate 69 having a press pin 68 which is upward directed; and a shifter 70. A cam groove is formed in a side face of each of the four plates 62, 65, 66, and 69, and the shifter 70.

The rear end portions of the four plates 62, 65, 66, and 69 are coaxially coupled to each other by a pin 71. The pin 71 is engaged with a long hole 70*a* of the shifter 70. Two front and rear drive pins 72 and 73 which elongate from the shifter 70 pass through the cam grooves of the plates 62, 65, 66, and 69. When the shifter 70 is longitudinally moved, the plates 62, 65, 66, and 69 are vertically swung in accordance with the shapes of their respective cam grooves.

In an initial state shown in FIG. 7A, first, the binding piece in the state where the legs are overlapped each other is inserted between the two presser plates 65 and 66.

Figure 7B:
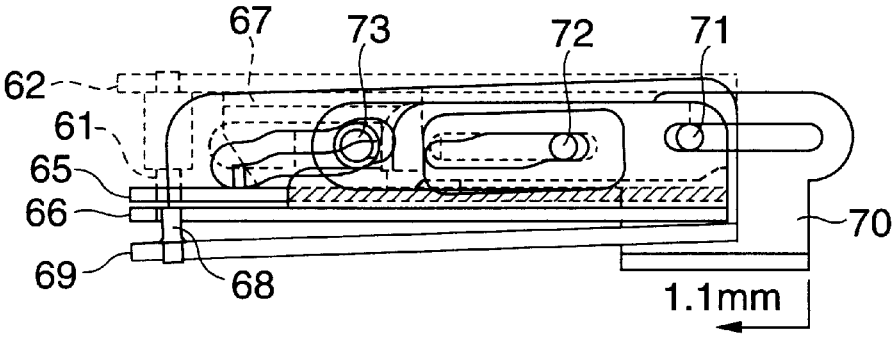
Figure 7C:
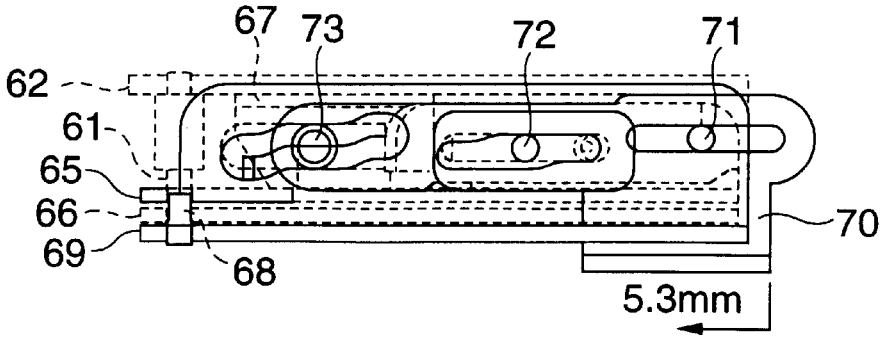

When the shifter 70 is forward moved, the lower presser plate 66 is raised, so that the legs of the binding piece is pressingly fixed by the upper and lower presser plates 65 and 66 as shown in FIG. 7B. Then, the press plate 69 is raised as shown in FIG. 7C, so that a dowel is press-formed in each of the legs, by the press pin 68.

Figure 8A:
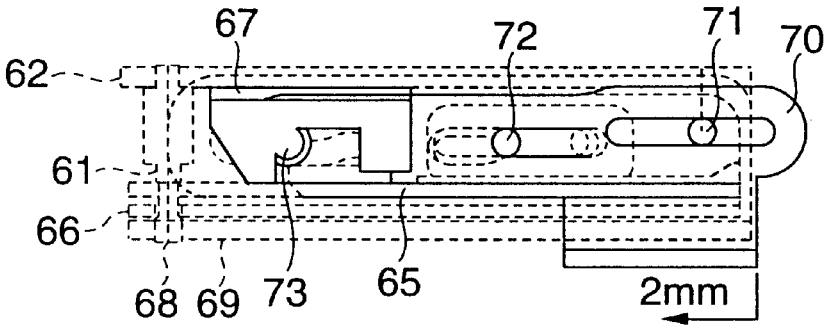
FIGS. 8A to 8C are views illustrating the crimping step and succeeding to FIGS. 7A to 7C.
Figure 8B:
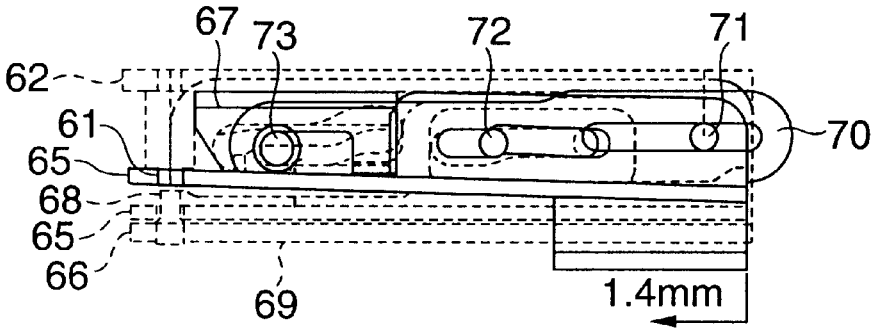
Figure 8C:
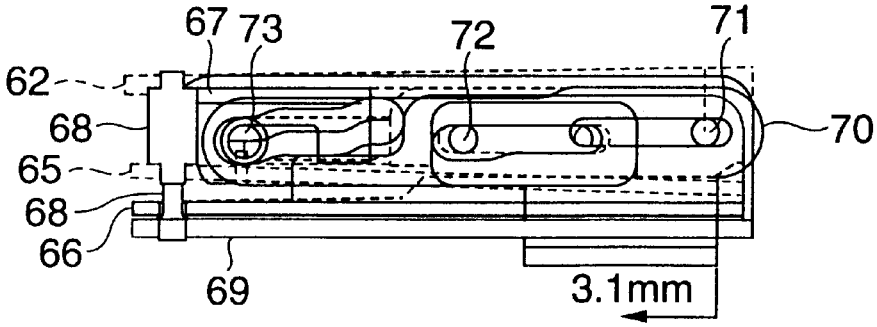

As shown in FIG. 8A, the lock plate 67 is then forward pushed so that the locking state of the upper presser plate 65 is canceled. As shown in FIG. 8B, therefore, the pressing due to the upper and lower presser plates 65 and 66 is canceled, and the upper presser plate 65 is raised. As shown in FIG. 8C, the crimp pin 61 of the crimp plate 62 then crushes the dowel formed by the press pin 68 through the hole 63 of the upper presser plate 65.

Figure 9A:
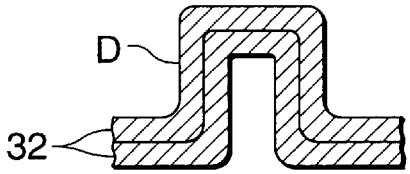
FIG. 9A is a section view showing a shape of a dowel shaped by the crimping device.
Figure 9B:
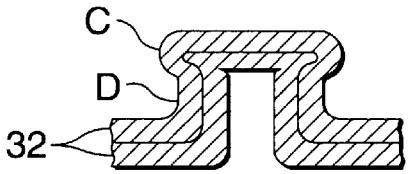
FIG. 9B is a section view showing a final shape obtained by crimping the dowel.
Figure 10:
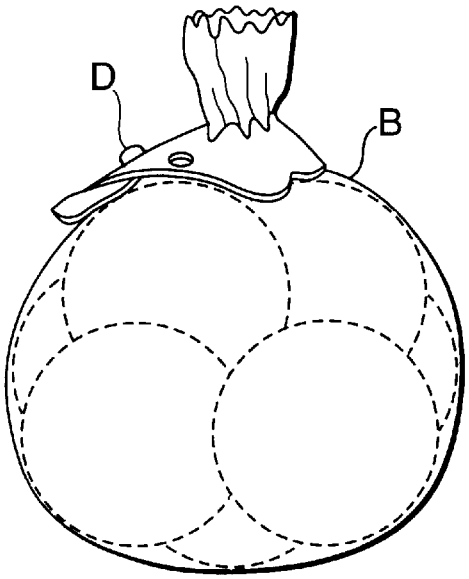
FIG. 10 is a front view of a bag which is bound by the bag binder of the invention.

FIG. 9A shows the shape of a dowel D which is formed by the press pin 68, and FIG. 9B shows the final shape of the dowel D which has undergone the crimping process C by the crimp pin 61. FIG. 10 shows a state where the binding piece 31 is fastened to the bag B.

Thereafter, the shifter 70 is retracted to go back to the initial state shown in FIG. 7A, the carrier 25 of the binding device 14 is retracted to return the binding piece guide slider 42, the cover slider 43, and the binding slider 44 to the initial positions shown in FIG. 5. The rear end of the carrier 25 pushes the stop switch 27, thereby ending one cycle of the operation.

In this way, the legs of the binding piece 31 are overlapped each other by laterally pressing the binding piece by the binding arms 48, and the legs are then crimped. As shown in FIG. 10, therefore, the binding piece 31 can be attached to the bag B in close proximity to the contents of the bag, so that the bag B is bound in a tension state.

The bag which has been bound can be opened in the following manner. The legs 32 of the binding piece 31 are pulled so as to be separated from each other by fingers. Then, the crimped dowel D is deformed, and the legs are separated from each other. The binding piece is detached from the bag, so that the bag can be opened. When the binding piece which is detached from the bag is to be reused, the legs 32 of the binding piece 31 are crossed with each other so as to attain the crosswise engaging state of the hooking portion 35. After the bags is once opened, the bag cannot be again bound by using the dowel in such a manner that the state before the opening is again attained, because the crimped portion C of the dowel D of the binding piece 31 is deformed. Therefore, the opening history of the bag can be easily checked in a visual manner. This is effective also in safety management and sanitary management during distribution of commodities.

Figure 11:
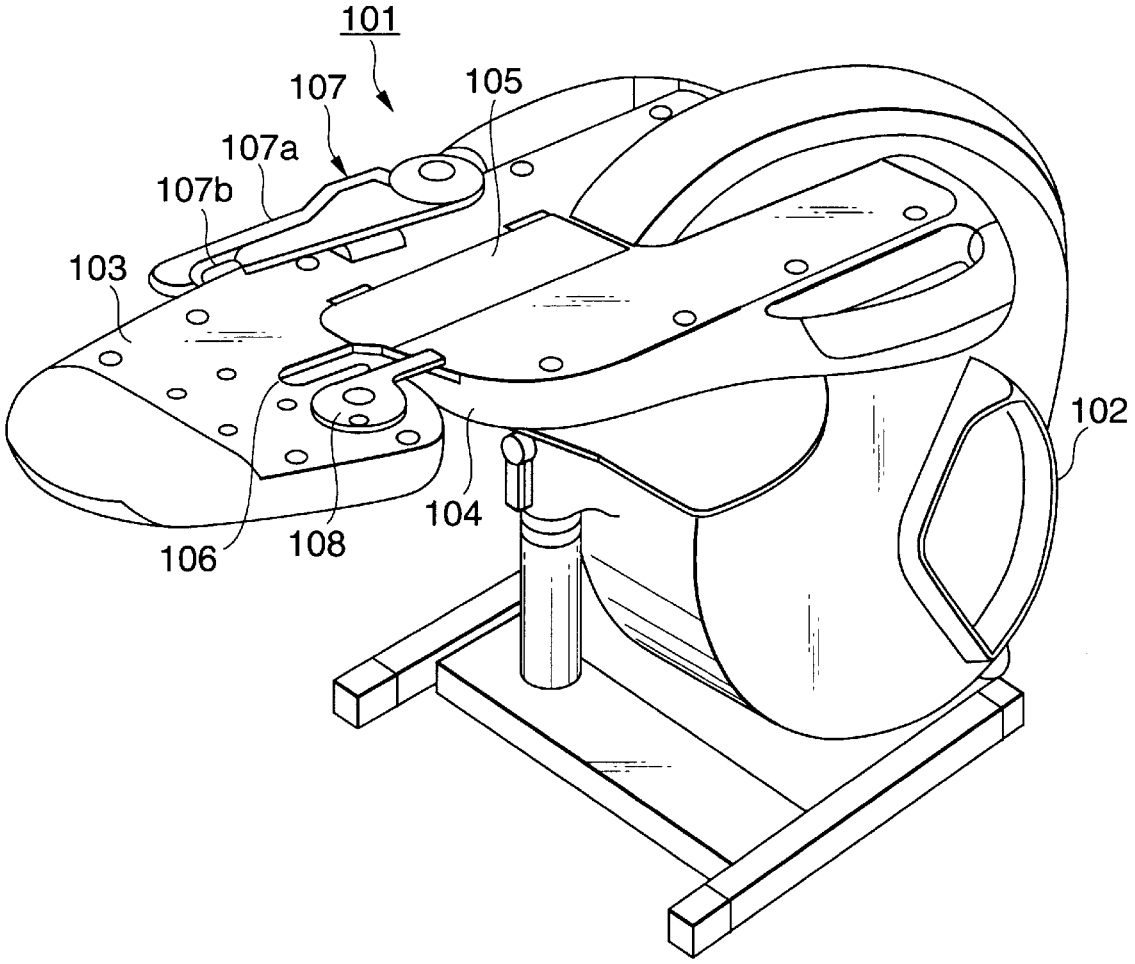
FIG. 11 is a perspective view of a bag binder which is a second embodiment of the invention.

Hereinafter, a second embodiment of the invention will be described with reference to FIGS. 10 to 15B. FIG. 11 shows a bag binder 101. The portion on the right side is a binding piece magazine 102 which houses a roll of binding pieces that are linked to one another into a belt-like shape.

A guide groove 104 is formed in a table 103, which leftward protrudes from the binding piece magazine 102. The guide groove has an L-like shape in a plan view, or elongates from a lateral center portion of the front face toward the inner side and is then bent leftward. In the table 103, a binding piece feeding device 105 is incorporated on the right side of the guide groove 104, and a binding device 106 on the left side of the guide groove.

A cutter device 107 is disposed behind the binding device 106. When an arm 107*a* which is pivotally mounted to the upper face of the table 103 is swung toward the front side so as to make a guide groove 107*b* in the front portion coincident with the guide groove 104 of the table 103, an upper extra portion of a bound bag is cut away by a cutter blade (not shown) which can longitudinally slide in the arm 107*a* with being interlocked with the binding operation.

The feeding device 105, the binding device 106, and the cutter device 107 are driven by a motor (not shown) via a reduction gear mechanism, and a cam and link mechanism. A trigger lever 108 is pivotally mounted to the left side of the guide groove 104. A tip end portion of the trigger lever 108 rightward elongates to cross the guide groove 104. When an opening portion of a bag is puckered and inserted into the guiding groove 104, the trigger lever 108 is pushed by the bag to swing, whereby a trigger switch (not shown) in the table 103 is turned on to activate the motor.

Figure 12:
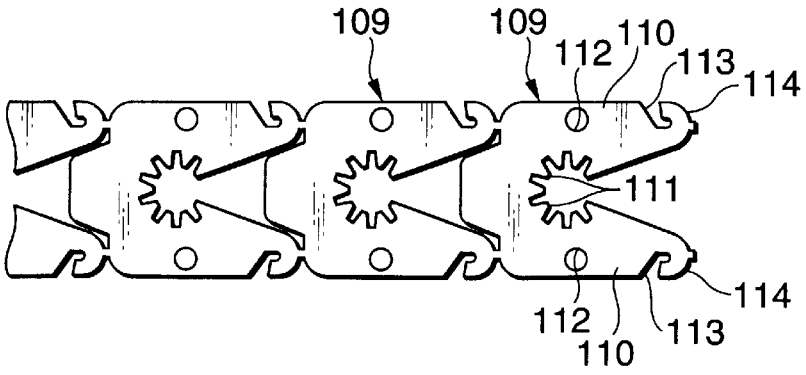
FIG. 12 is a front view of a binding piece.

As shown in FIG. 12, a binding piece 109 is formed by a resin flat plate having a substantially portal shape. A locking pawl portion 111 in the form of internal teeth is disposed in an internal basal portion between right and left legs 110. Holes 112 with which pins (described later) of the feeding device 105 are to be engaged are formed in the legs 110, respectively. A groove 113 which elongates from the outer side face to the front inner side is formed in the tip end portion of each of the legs, thereby constituting a hooking portion 114. A number of binding pieces 109 are integrally molded into a belt-like shape with being aligned in a row. The belt of binding pieces is wound into a roll, and then loaded into the binding piece magazine 102 of the bag binder 101.

Figure 13:
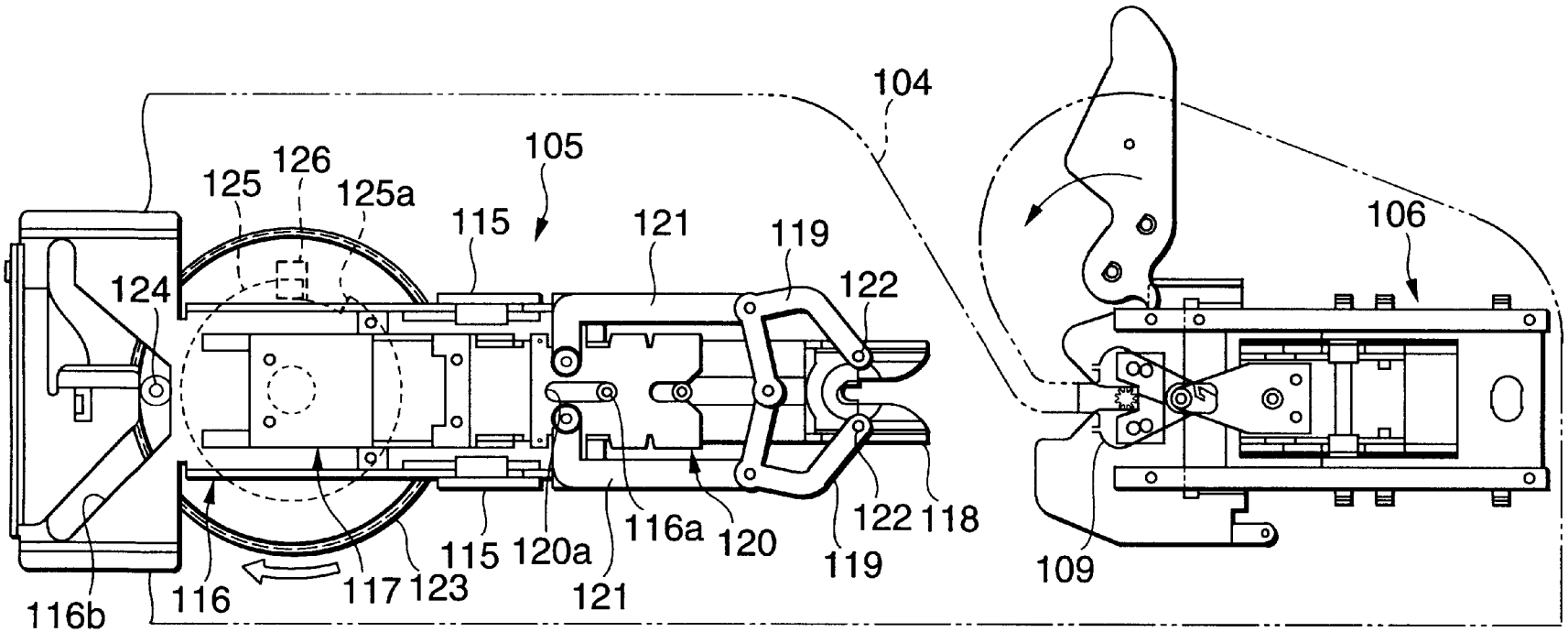
FIG. 13 is a plan view showing a feeding device and a binding device of the bag binder.

FIG. 13 shows the arrangement of the feeding device 105 and the binding device 106. As shown in the figure, a carrier 116 is engaged with a carrier guide 115 disposed on the base of the bag binder 101, so as to be longitudinally slidable. When the carrier 116 is advanced toward the binding device 106, the binding piece 109 is fitted onto the bag, and the binding piece 109 attached to the bag is fastened by the binding device 106.

A binding piece guide 117 is attached onto the carrier 116 of the feeding device 105 so as to be longitudinally slidable and has upper and lower cases. A gap between the upper and lower cases functions as a binding piece passageway in which the center portion is higher (which has an L-like section shape). A binding piece table 118 which is similar in shape to the binding piece 109 is formed in a front portion (in the figure, the left portion) of the binding piece guide 117. The binding piece 109 which is forward fed through the binding piece passageway is exposed on the binding piece table 118.

A pair of right and left C-shape binding arms 119 are coaxially and pivotally mounted to a rear portion of the binding piece table 118. The binding arms 119 are coupled via links 121 to an arm shifter 120 which is behind the binding arms 119 and longitudinally slidable. A vertical pin 122 protrudes from the tip end portion of each of the binding arms 119. The pins 122 are engaged with the holes 112 on the both sides of the binding piece 109 shown in FIG. 12. A pin 116*a* fixed to the carrier 116 is engaged with a groove 120*a* formed in the arm shifter 120.

A larger-diameter main gear 123 is disposed below the carrier 116. A crank roller 124 disposed in the vicinity of the outer edge of the main gear 123 is engaged with a cam groove 116*b* formed in the rear portion of the carrier 116.

The main gear 123 is coupled with the motor via plural reduction gears (not shown).

Although illustration is omitted, a feeding pawl mechanism (not shown) which uses swinging pawls is interposed between the carrier 116 and the binding piece guide 117. Feeding pawls which are pivotally mounted to the binding piece guide 117 are engaged with the carrier 116. The binding piece guide 117 is pushed by the carrier 116 so as to be advanced together with the carrier 116. When the binding piece guide 117 is advanced by a predetermined distance, the guide abuts against a stopper and stops, and the feeding pawls are disengaged from the carrier 116. The carrier 116 and the arm shifter 120 are further advanced, so that the pair of right and left binding arms 119 are pushed by the arm shifter 120 and are swung in the closing direction.

A disk 125 in which a notch 125*a* is formed is fitted onto the shaft of the main gear 123. A light emitting portion and a light receiving portion of a photo-interrupter 126 fixed to a frame (not shown) are vertically opposed to each other across the outer edge portion of the disk 125. The photo-interrupter 126 is connected to a motor control unit (not shown). The motor control unit controls the stop position of the carrier 116 in accordance with an output of the photo-interrupter 126.

Next, the operation of the bag binder 101 will be described. When the upper end opening portion of a resin bag into which vegetables or fruits are disposed is inserted into the guiding groove 104 while puckering the opening portion by a hand, the trigger lever 108 is pushed by the bag to swing, and the trigger lever turns on the trigger switch in the table 103 to activate the motor.

When the main gear 123 is rotated by the motor, the carrier 116 and the binding piece guide 117 are pushed by the crank roller 124 shown in FIG. 13 so as to be advanced. Since the leading one of the binding pieces 109 is engaged with the pins 122 of the binding arms 119, the leading binding piece is advanced together with the binding piece guide 117 and then fitted onto the puckered portion of the bag. Although illustration is omitted, a cutter which is attached to the upper face of the binding piece guide 117 cuts the portion where the leading binding piece and the next binding piece are linked to each other.

Figure 14A:
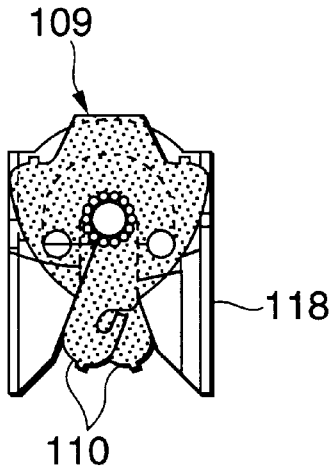
FIGS. 14A and 14B are a plan view and a front view showing a state where the binding piece is bent by the feeding device, respectively.
Figure 14B:
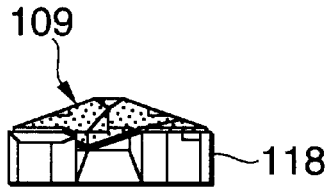

In the position where the binding piece on the binding piece table 118 of the binding piece guide 117 enters the front portion of the binding device 106, the feeding pawls of the binding piece guide 117 are disengaged from the carrier 116 and the binding piece guide 117 stops. The carrier 116 and the arm shifter 120 are further advanced. As a result, the pair of right and left binding arms 119 which are pivotally mounted to the binding piece guide 117 are swung in the closing direction, so that the legs of the leading binding piece 109 cross each other. As a result, the binding piece 109 is elastically deformed into a funnel-like shape as shown in FIGS. 14A and 14B. At this time, a press pin of the binding device 106 is positioned directly below the legs 110 of the binding piece 109.

The binding device 106 is configured in the same manner as that of the first embodiment, and hence its detailed description is omitted. A plate from which a punch protrudes, and an upper die plate having a pin hole which serves as a die cooperate to vertically press the legs 110 of the binding piece 109, thereby forming a dowel in the crosswise portions of the legs. The dowel is crimped from the upper side by a crimp plate having a crimp pin.

Figure 15A:
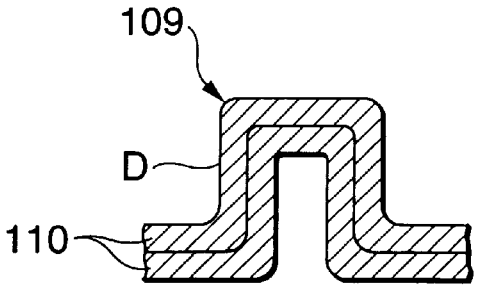
FIG. 15A is a section view showing the shape of a dowel shaped by the binding device
Figure 15B:
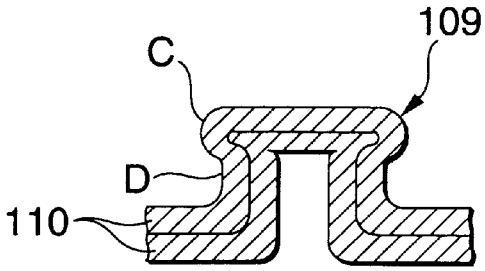
FIG. 15B is a section view showing the shape of the dowel which is crimped in the succeeding step.

FIG. 15A shows the shape of a dowel D which is formed by the punch and the die, and FIG. 15B shows the final shape of the dowel D which has undergone the crimping process C by the crimp pin. A state where the binding piece 109 is fastened to the bag B is shown in FIG. 10.

The upper and lower plates of the binding device 106 are then opened to return to their waiting positions, and the carrier 116 is retracted by a predetermined distance. Thereafter, the feeding pawls of the binding piece guide 117 are engaged with the carrier 115, and the binding piece guide 117 is retracted integrally with the carrier 116. When the notch 125*a* of the disk 125 which is coaxial with the main gear 123 reaches a space between the light emitting portion and the light receiving portion of the photo-interrupter 126 for detecting a waiting position, an ON signal of the photo-interrupter 126 causes a motor control unit to start the braking of the motor or enter the deceleration step. At the timing when the notch 125*a* goes out from the space between the light emitting portion and the light receiving portion of the photo-interrupter 126 and the ON signal of the photo-interrupter 126 is turned off, an electromagnetic brake is applied to the motor and the guide stops at a waiting position shown in FIG. 13.

The bag which has been bound can be opened in the following manner. The legs 110 of the binding piece 109 are pulled so as to be separated from each other by fingers. Then, the crimped dowel D is deformed, and the legs are separated from each other. The binding piece is detached from the bag, so that the bag can be opened. When the binding piece which is detached from the bag is to be reused, the legs 110 of the binding piece 109 are crossed with each other so as to attain the crosswise engaging state of the locking pawl portion 111 at the tip end. After the bags is once opened, the bag cannot be again bound by using the dowel in such a manner that the state before the opening is again attained, because the crimped portion C of the dowel D of the binding piece 109 is deformed. Therefore, the opening history of the bag can be easily checked in a visual manner.

This is effective also in safety management and sanitary management during distribution of commodities.

Hereinafter, a third embodiment of the invention will be described with reference to FIGS. 10 to 12, and 16 to 19B.

In the description of the embodiment, the components which are identical with or have the same function as those of the first or second embodiment are denoted by the same reference numerals, and their description is omitted.

Figure 16:
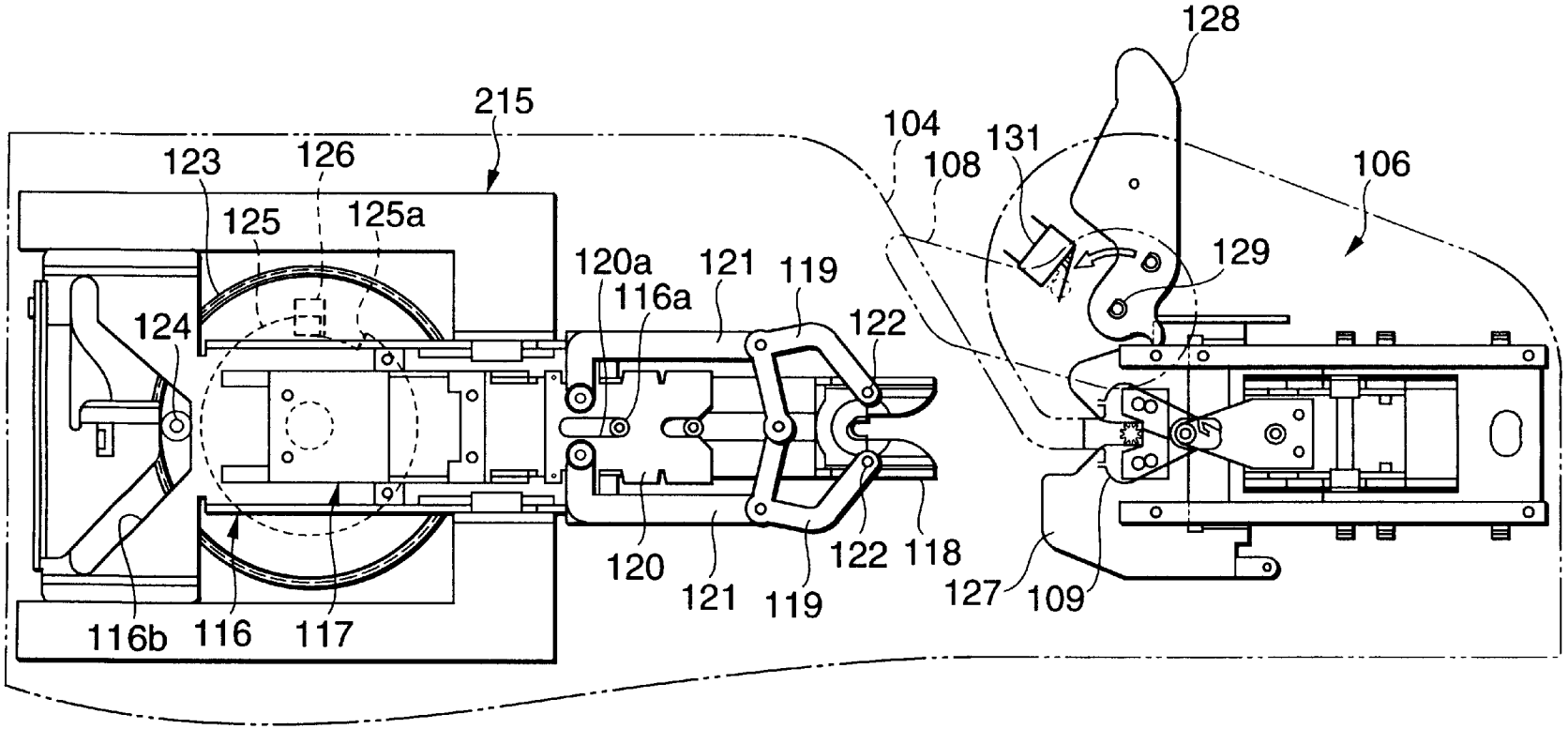
FIG. 16 is a plan view showing a feeding device and a press-bonding device of the bag binder.
Figure 17:
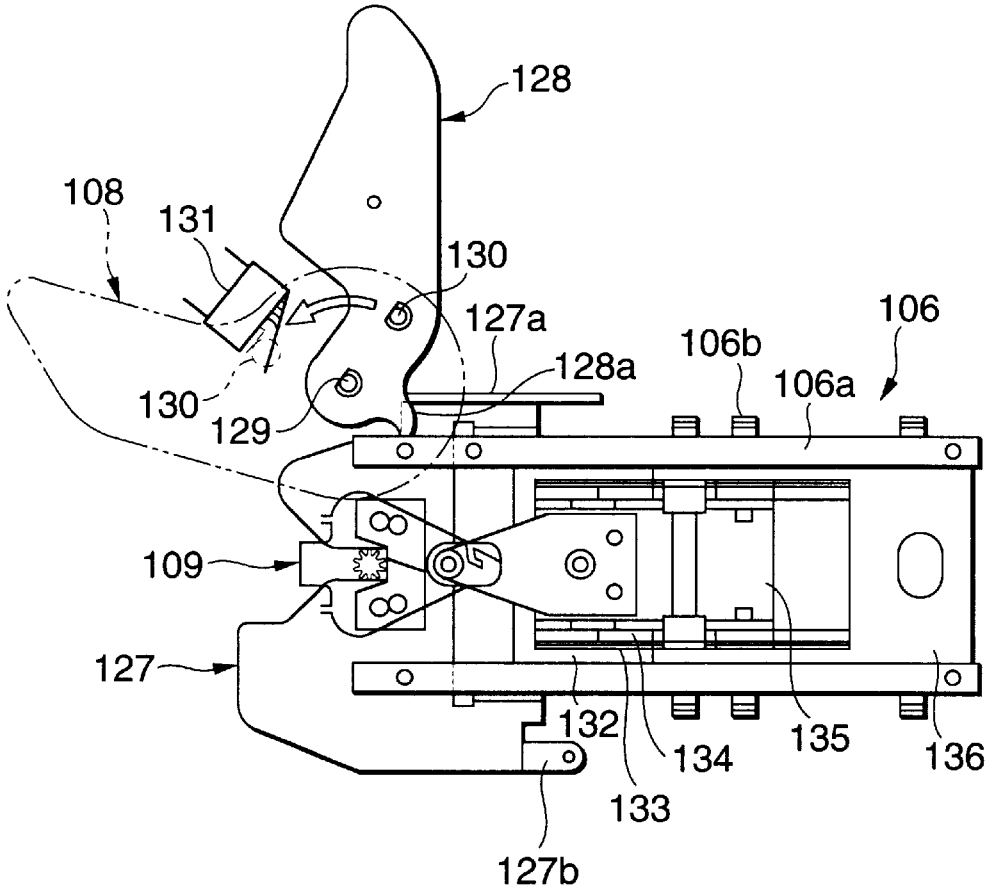
FIG. 17 is a plan view showing a flap and a trigger lever.

In the third embodiment, as shown in FIG. 16, a flap 127 is pivotally mounted to a front portion of a binding device 106. The flap 127 closes the lower open face of the guide groove 104. As shown in FIG. 17 in an enlarged manner, at the left end (in the figure, the upper side) of the flap 127 as seen from the feeding device, a stopper 127*a* for restricting the swing of the trigger lever 108 and a sub trigger lever 128 is raised. The center portion of the front edge is recessed so as not to impede the insertion of a bag into the guide groove 104. The flap 127 is pressingly contacted with the lower face of the table 103 of the bag binder 101 by a tension spring (not shown) elongating between a lug 127*b* which is raised from the right rear end portion and a frame of the binder.

A shaft 129 for the trigger lever 108 exposed over a case of the bag binder 101 and the sub trigger lever 128 disposed below the case is positioned in front of the left end portion of the flap 127. The trigger lever 108 in the upper side and the sub trigger lever 128 in the case are coupled to each other by a pin 130. A pawl 128*a* is formed in the sub trigger lever 128. In the initial position, the pawl protrudes toward the left edge portion of the flap 127. The stopper 127*a* in the left end of the flap 127 and the pawl 128*a* of the sub trigger lever 128 constitute a safety device.

When a bag is inserted, the trigger lever 108 and the sub trigger lever 128 are swung from the initial positions shown in FIG. 17 in a counterclockwise direction, the pin 130 pushes a lever of a trigger switch 131 to activate the bag binder 101. The sub trigger lever 128 is displaced with respect to the trigger lever 108 by about 90 degree in a clockwise direction in the figure. When the bag pushes the trigger lever 108, the bag is inserted into the guide groove 104 with being sandwiched between the trigger lever 108 and the sub trigger lever 128, and then pushed by the sub trigger lever 128 so as to be surely inserted into the binding piece feeding passageway. When the bag is removed away, the trigger lever 108 and the sub trigger lever 128 are returned to the initial positions by a spring (not shown).

Figure 18:
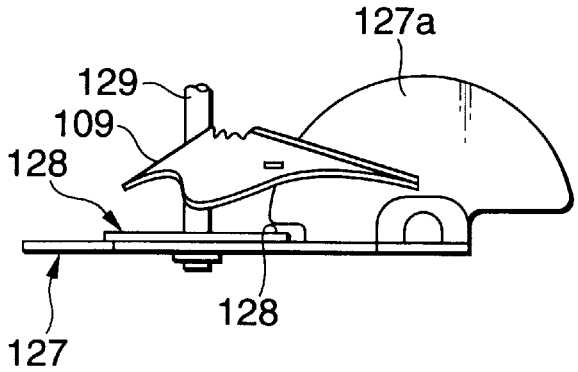
FIG. 18 is a side view showing the trigger lever and the flap in an initial position.
Figure 19A:
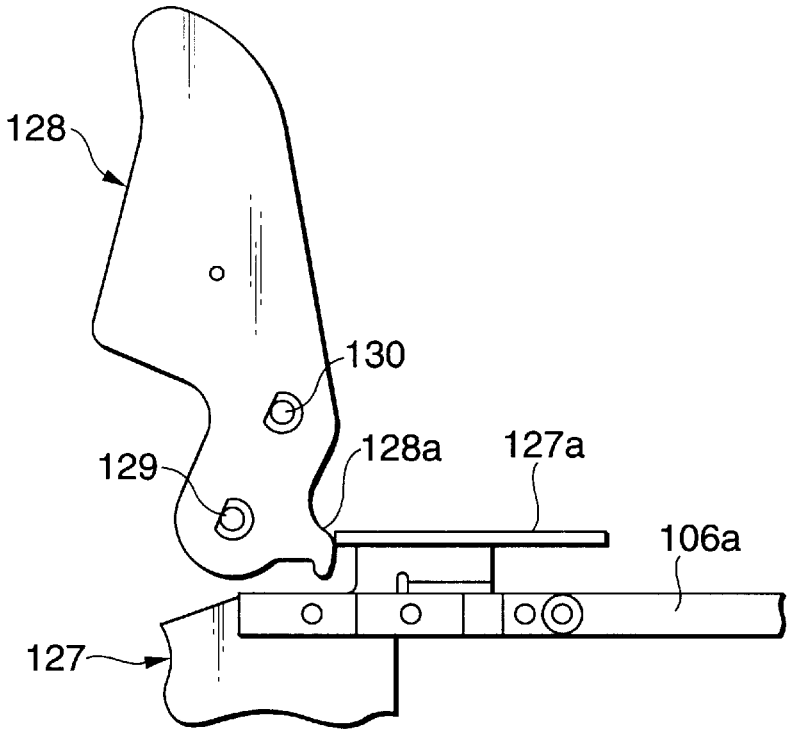
FIGS. 19A and 19B are a plan view and a side view showing the trigger lever and the flap in an open state, respectively.
Figure 19B:
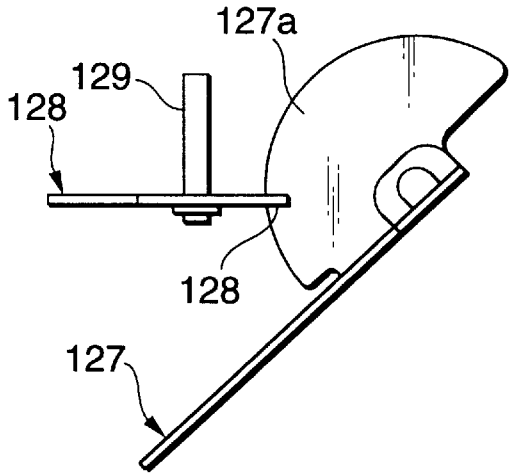

As shown in FIG. 18, the lower end of the front portion of the semicircular stopper 127*a* of the flap 127 is removed away so as not to interfere with the pawl 128*a* of the sub trigger lever 128. As shown in the figure, when the flap 127 is in the initial position, the trigger lever 108 and the sub trigger lever 128 can be freely swung. As shown in FIGS. 19A and 19B, when the flap 127 is downward swung, the stopper 127*a* advances into the radius of rotation of the pawl 128*a* of the sub trigger lever 128. When the trigger lever 108 and the sub trigger lever 128 are disposed to be swung from the initial positions, the pawl 128*a* bumps against the stopper 127*a* to block the swinging operations of the trigger lever 108 and the sub trigger lever 128. When the flap 127 is opened, therefore, the trigger lever cannot be swung, thereby attaining the safety in the case such as that where the flap 127 is opened and a binding piece jammed in the binding device 106 is to be removed away.

The binding device 106 is configured in the same manner as that of the first embodiment, and hence its detailed description is omitted. A base plate 132 is fixed to the lower portion of a frame 106*a* of the binding device.

A lower release plate 133, a center die plate 134, and an upper press plate 135 are pivotally mounted to a stationary shaft 106*b* which is disposed above the base plate. The three plates 133, 134, and 135 are lowered or raised by a shifter 136 which is longitudinally moved. The base plate 132 from which a punch is raised, and the die plate 134 which is above the base plate and in which a pin hole serving as a die is formed cooperate to vertically press the crosswise portions of the legs of the binding piece 109, thereby forming a dowel.

The dowel is crimped from the side above the pin hole by a crimp pin of the press plate 135 which is above the die plate 134. The binding piece 109 is pulled out from the punch of the base plate 132 by the release plate 133.

Next, one cycle of the operation of the bag binder 101 will be described. When the upper end opening portion of a resin bag into which vegetables, fruits, or the like are disposed is inserted into the guiding groove 104 while puckering the opening portion by a hand, the trigger lever 108 is pushed by the bag to swing. As shown in FIG. 17, the pin 130 coupling the trigger lever 108 and the sub trigger lever 128 turns on the trigger switch 131, thereby activating the motor.

When the main gear 123 is rotated by the motor, the carrier 116 and the binding piece guide 117 are pushed by the crank roller 124 shown in FIG. 16 so as to be advanced. Since the leading one of the coupled binding pieces 109 is engaged with the pins 122 of the binding arms 119, the leading binding piece is advanced together with the binding piece guide 117 and then fitted onto the puckered portion of the bag. Although illustration is omitted, a cutter which is attached to the upper face of the binding piece guide 117 cuts the portion where the leading binding piece and the next binding piece are linked to each other.

In the position where the binding piece 109 enters the front portion of the binding device 106, the feeding pawls of the binding piece guide 117 are disengaged from the carrier 116 and the binding piece guide 117 stops. The carrier 116 and the arm shifter 120 are further advanced. As a result, the pair of right and left binding arms 119 which are pivotally mounted to the binding piece guide 117 are swung in the closing direction, so that the legs of the leading binding piece 109 cross each other. As a result, the binding piece 109 is elastically deformed into a dome-like shape. At this time, the legs of the binding piece 109 enter the space between the die plate 134 and the release plate 133 of the binding device 106.

Thereafter, the binding device 106 crimps the binding piece 109 to fasten it. After the crimping step, the feeding device 105 performs the returning step. When the carrier 116 is retracted by a predetermined distance, the feeding pawls of the binding piece guide 117 are engaged with the carrier 115, and the binding piece guide 117 is retracted integrally with the carrier 116. The combination of the disk 125 and the photo-interrupter 126 detects that the guide reaches the waiting position, and the guide stops at the waiting position shown in FIG. 16. After the crimping, the worker pulls down the bag. Then, the bag is pulled out to a space below the table 103 of the bag binder 101. FIG. 10 shows a state where the binding piece 109 is fastened to the bag B.

When the binding piece 109 is jammed in the binding device 106 by any reason, the flap 127 in the lower face of the table 103 is downward opened, and the binding piece 109 remaining in the binding device 106 is removed away. At this time, as shown in FIGS. 19A and 19B, the stopper 127*a* of the flap 127 blocks the swinging operations of the trigger levers 108 and 128. Even if the worker erroneously touches the trigger lever 108, therefore, the lever is not swung to the activating position, and hence the binding piece can be safely removed away.

In other words, when an accident such as that a binding piece cannot be removed from the punch of the binding device or that a binding piece is jammed in the press-bonding device by any reason occurs, the binding piece must be removed away while opening the flap disposed in a portion where the binding device is incorporated. When the worker touches the trigger lever in the vicinity of the press-bonding device during the work of removing the binding piece, the motor is activated, thereby producing a fear that a finger is squeezed by the feeding device and the binding device or that a finger is damaged by the cutter device for cutting an upper extra portion of the bag. According to the third embodiment, such a fear can be eliminated.

The invention is not restricted to the embodiments described above, and may be variously modified without departing from the technical scope of the invention. It is a matter of course that such modifications are within the scope of the invention.

As described above, according to the first aspect of the invention, the bag binder attaches a binding piece to a puckered portion of a bag by pressing the outer side of the legs of the binding piece. Unlike a bag binder of the prior art which attaches a binding piece to a bag by twisting legs of the binding piece, therefore, a binding piece can be attached to a bag in close proximity to contents of the bag, so that the bag is bound in a tension state. Consequently, damages due to abrasion between contents of a bag can be prevented from occurring, and a bag containing commodities can be easily handled. The invention is preferably applied to packing of commodities which are readily damaged, such as vegetables, or fruits.

According to the second aspect of the invention, the rotation position of the main gear for driving the binding mechanism is detected by the photo-sensor, and the stop position is controlled in accordance with a signal of the photo-sensor. Therefore, the accuracy of the control of the waiting position is improved, and the invention can attain an effect in stabilization of the binding operation.

According to the third aspect of the invention, in the case such as that where a binding piece jammed in the bag binder is to be removed away, when the flap covering the binding mechanism is opened, the trigger lever cannot be swung. Therefore, an accident caused by an erroneous operation of the trigger lever can be prevented from occurring, and hence the safety is improved.

What is claimed is:

1. A binding machine for binding a bag comprising:

a binding-piece feeding member for feeding a binding piece to a position adjacent to said bag, said binding piece made of a synthetic resin and including a pair of leg portions for binding said bag;

a crossing member for crossing said leg portions by pressing said leg portions of said binding piece; and a bonding member for bonding said leg portions of said binding piece so as to crosswise engage a crossed portion of said leg portions to each other, wherein said bonding member includes a press-bonding member.

2. A binding machine according to claim 1, wherein said press-bonding member comprises a forming member for forming a dowel portion on said crossed portion of said leg portions and a crimping device for crimping said dowel portions.

3. A binding machine according to claim 1, wherein said crossing member comprises a pair of binding arms which are located at a portion adjacent to a tip of said binding-piece feeding member.

4. A binding machine according to claim 1, further comprising a controller for controlling a binding operation with said binding-piece feeding member, said crossing member, and said bonding member, said controller comprising;

a main gear driven by a motor, one rotation of which performs one cycle of said binding operation;

a disk coaxially attached to said main gear, said disk including an index portion provided at an edge portion of said disk; and a photo-sensor detecting said index portion so as to detect one cycle of said binding operation.

5. A binding machine according to claim 4, wherein said photo-sensor outputs one of an on-signal and an off-signal corresponding to a detected result of detecting said index portion with said photo-sensor.

6. A binding machine according to claim 5, wherein said motor drives a drive system for driving at least one of said binding-piece feeding member, said crossing member, said bonding member, said main gear and said disk; and wherein said driving system decelerates when said detected result changes from one of said on-signal and said off-signal to the other signal during said binding operation.

7. A binding machine according to claim 6, wherein said motor is stopped after a deceleration period of said driving system.

8. A binding machine according to claim 4, wherein said index portion is a notch.

9. A binding machine according to claim 1, further comprising;

a trigger lever which starts one cycle of a binding operation with said binding-piece feeding member, said crossing member, said bonding member; and a flap lid provided on said bonding member, said flap lid including a stopper for restricting a rotation of said trigger lever.

10. A binding machine according to claim 9, wherein said stopper restricts said rotation of said trigger lever by means that said stopper is projected on a rotating route of said trigger lever while said flap lid is opened, wherein said stopper allows said rotation of said trigger lever by means that said stopper is moved away from said rotating route of said trigger lever while said flap lid is closed.

* * * * *